US012213565B2

(12) United States Patent
Pievani

(10) Patent No.: US 12,213,565 B2
(45) Date of Patent: Feb. 4, 2025

(54) SLIDER FOR ZIP FASTENERS

(71) Applicant: BOTTONIFICIO B.A.P. S.P.A., Villongo (IT)

(72) Inventor: Roberto Pievani, Foresto Sparso (IT)

(73) Assignee: BOTTONIFICIO B.A.P. S.P.A., Villongo (IT)

( * ) Notice: Subject to any disclaimer, the term of this patent is extended or adjusted under 35 U.S.C. 154(b) by 124 days.

(21) Appl. No.: 18/029,176

(22) PCT Filed: Sep. 29, 2021

(86) PCT No.: PCT/IB2021/058881
§ 371 (c)(1),
(2) Date: Mar. 29, 2023

(87) PCT Pub. No.: WO2022/070050
PCT Pub. Date: Apr. 7, 2022

(65) Prior Publication Data

US 2023/0380550 A1 Nov. 30, 2023

(30) Foreign Application Priority Data

Sep. 30, 2020 (IT) ..... 102020000023023

(51) Int. Cl.
*A44B 19/30* (2006.01)

(52) U.S. Cl.
CPC ..... *A44B 19/303* (2013.01)

(58) Field of Classification Search
CPC ..... A44B 19/303
See application file for complete search history.

(56) References Cited

U.S. PATENT DOCUMENTS 2,261,132 A * 11/1941 Poux ..... A44B 19/305 24/429
2,303,750 A * 12/1942 Marinsky ..... A44B 19/305 24/418
4,768,263 A * 9/1988 Fukuroi ..... A44B 19/306 24/421
5,031,286 A * 7/1991 Kedzierski ..... A44B 19/26 24/429
5,167,052 A * 12/1992 Aoki ..... A44B 19/306 24/421
5,528,802 A * 6/1996 Akashi ..... A44B 19/303 24/421
5,625,927 A * 5/1997 Chu ..... A44B 19/306 24/421
5,806,151 A * 9/1998 Uchiyama ..... A44B 19/303 24/418

(Continued)

FOREIGN PATENT DOCUMENTS

EP 0743024 A2 11/1996
GB 2510579 A 8/2014

*Primary Examiner* — Jason W San
(74) *Attorney, Agent, or Firm* — Dykema Gossett PLLC

(57) ABSTRACT

A zip slider (1) is described comprising a slider body (110); a lock mechanism (200) for locking the sliding movement of the slider (1) that is positioned in the slider body (110) and comprising a movable stop element (210) for stopping the sliding movement of the slider (1) in a longitudinal direction and in the zip opening direction and a release button (300) for unlocking the lock mechanism (200), slidably mounted in the slider body (110) and manually operable to unlock the lock mechanism (200).

23 Claims, 8 Drawing Sheets

(56) References Cited

U.S. PATENT DOCUMENTS

Figure 2:
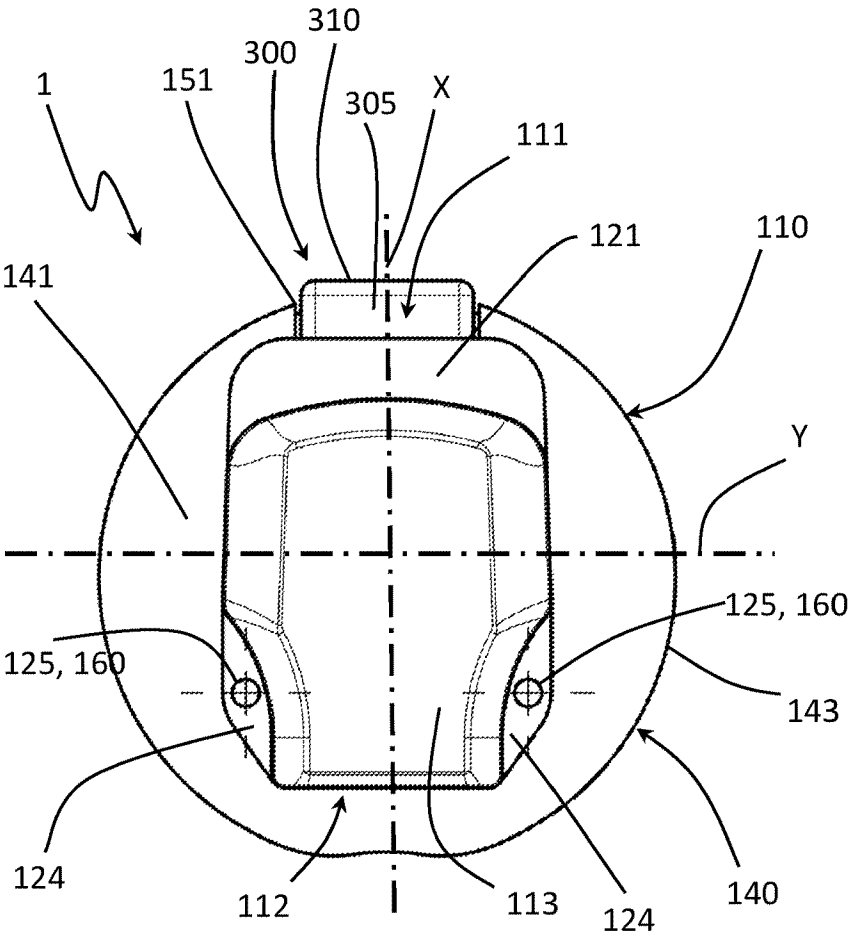

| | | | | | |
|---|---|---|---|---|---|
| 5,898,979 | A * | 5/1999 | Hamada | A44B 19/306 | 24/418 |
| 6,112,375 | A * | 9/2000 | Yuki | A44B 19/306 | 24/429 |
| 7,219,402 | B2 * | 5/2007 | Yamazaki | A44B 19/308 | 24/429 |
| 8,991,017 | B2 * | 3/2015 | Hamada | A44B 19/30 | 24/429 |
| 9,271,548 | B2 * | 3/2016 | Keyaki | A44B 19/26 | |
| 2005/0125968 | A1 * | 6/2005 | Yamazaki | A44B 19/308 | 24/429 |
| 2014/0041163 | A1 * | 2/2014 | Hamada | A44B 19/30 | 24/418 |
| 2016/0316861 | A1 * | 11/2016 | Meehan | A44B 19/262 | |
| 2019/0343242 | A1 * | 11/2019 | Liu | A44B 11/25 | |

* cited by examiner

SLIDER FOR ZIP FASTENERS

CROSS-REFERENCE TO RELATED APPLICATION

This application is a national stage filing based upon International application No. PCT/IB2021/058881, filed 29 Sep. 2021, which claims the benefit of priority to Italy application No. 102020000023023, filed 30 Sep. 2020.

The present invention relates to a slider for zip fasteners and, in particular, for zip fasteners that can be used in items of clothing, footwear and other fashion accessories.

The sliders for zip fasteners comprise a main body configured to slidably receive two arrays of teeth of a zip fastener.

To this end, the main body comprises, at a first end, two internal channels which converge, substantially at a central portion of the main body, into a single channel reaching the second longitudinally opposite end of the main body.

The teeth of a zip fastener are inserted into the first end of the main body in such a way that one row of teeth engages one channel and the other row of teeth engages the other channel.

By sliding the main body along a first direction, the two rows of teeth converge into the central portion of the main body (where the two channels converge into a single channel) coupling each other in such a way that the teeth of one row fit between the teeth of the other row, closing the zip.

By sliding the main body in a second direction opposite to the first one, the two rows of teeth coupled together enter the second end of the main body (where a single channel is present) and are split near the central portion of the main body where the single channel splits in two, causing the zip to open.

In order to allow the movement of the main body a pull tab, i.e., an element that can be grasped by a user, is usually provided, the pull tab being connected to the main body of the slider to allow the movement of the slider as a whole in the desired direction.

Some sliders for zip fasteners, so-called "self-locking", are provided with a lock mechanism for locking the sliding movement of the slider in the opening direction of the zip fastener, so as to prevent an unwanted opening of the zip fastener when a user is wearing, for example, an item of clothing or footwear.

To this end, these so-called "self-locking" zip sliders are in particular, provided with a lock mechanism of the sliding movement of the slider comprising a movable stop element of the sliding movement of the slider in a longitudinal direction and in the opening direction of the zip fastener, and with a pull tab provided at one end with an eyelet that defines a portion, generally semi-annular, configured to interact with the movable stop element.

A very popular type of so-called "self-locking" zip sliders provides for a bridge to be associated with the main body of the slider, the bridge housing the aforesaid movable stop element and at the same time links the eyelet to the main body.

Specifically, this bridge of the slider is located at the upper surface of the main body of the slider and is bound to a pair of appendices which protrude from the upper surface of the main body.

The bridge, extending between the two appendices, defines, in combination with the upper surface of the main body, a through opening. This through opening is engaged by the eyelet of the pull tab, so that the latter can rotate with respect to the main body and also transfer the action exerted by the user to move the central body.

By means of this configuration, by lifting the pull tab and by moving the same in the opening direction of the zip fastener the movable stop element is also moved away from the teeth of the zip fastener, allowing the slider to slide and, consequently, the zip to open.

The Applicant has found that, on occasion, the pull tab of the zip fasteners may be moved unintentionally during use of the article on which the zip fastener is applied and may cause an unwanted opening of the zip fastener.

The applicant also found that the presence of the pull tab and, above all, of the elements of the slider which protrude from its visible surface (the bridge which houses the aforesaid movable stop element and the appendices to which it is bound) does not always match with the aesthetic characteristics which it would be desirable to impart to the slider of the zip fastener.

For example, for certain fashion styles, it would be desirable to be able to apply a logo, such as the one of the fashion house, or another decorative element to the slider of the zip fastener which logo, for example, reflects the style of the moment or complements a certain line of clothing or footwear.

The slider of the zip fasteners so-called "self-blocking" of the type described above do not, however, allow this need to be satisfied.

In this context, the Applicant has perceived that in order to avoid undesired openings of the zip fastener and to achieve these desirable aesthetic characteristics, it is necessary to rethink the overall structure of the slider so as to maintain "self-locking" characteristics, but at the same time to allow logos or decorative elements to be applied on the upper portion (the visible portion) of the slider body, if desired.

In this respect, the Applicant has perceived that in order to achieve the aforesaid desirable characteristics, it is necessary, firstly, to eliminate the operating pull tab of the movable stop element of the lock mechanism of the sliding movement of the slider and, secondly, to suitably configure the slider body in order to be able to house both the aforesaid lock mechanism and the relevant operating elements.

The present invention therefore relates to a slider for zip fasteners as defined in the appended claim 1.

More particularly, the present invention relates to a zip slider comprising:

- a slider body comprising a first end on which two longitudinal sliding channels for teeth of a zip fastener open and a second end at which a single longitudinal sliding channel for the teeth of a zip fastener opens, the two channels joining in said single channel in said slider body;
- a lock mechanism of the sliding of the slider positioned in the slider body and comprising a movable stop element of the sliding of the slider in a longitudinal direction and in an opening direction of the zip fastener;
- a release button, slidably mounted in the slider body and manually operable to unlock the lock mechanism;
- wherein the slider lacks any operating pull tab configured to interact with the lock mechanism; and
- wherein the release button is configured to cooperate with the movable stop element of the lock mechanism and move the movable stop element from an operative position, wherein the movable stop element engages one of said channels for locking a sliding of the slider along an opening direction of the zip fastener, to a non-operative position wherein the movable stop element does not engage any of said channels.

Advantageously, thanks to the aforesaid combination of features, the slider according to the invention allows to effectively prevent that any movement, even the most abrupt one, of the article to which the zip fastener is applied can lead to an accidental opening of the zip fastener itself.

The absence of any operating pull tab configured to interact with the lock mechanism and the presence in its place of a release button, slidably mounted in the slider body, allows to prevent any accidental movement of the control element of the movable stop element, i.e., of the release button.

As a matter of fact, the zip fastener can only be opened by manually operating the release button, which is slidably mounted in the slider body in a longitudinal direction, and requires an intentional action by the user, in this case exerting a pressure on the release button in the opening direction of the zip fastener.

Only in this way the slider body can longitudinally slide to open the zip fastener, thereby substantially eliminating the possibility that the movable stop element of the lock mechanism of the sliding of the slider may be unintentionally operated as a result of an accidental contact with the operating element thereof or of an occasional movement of the article to which the zip fastener is applied.

In relation to the slider of the invention, it should be specified that, in order to meet particular application and/or aesthetic needs, a pull tab may possibly be envisaged, provided that it is not configured to interact with the movable stop element of the lock mechanism of the sliding movement of the slider.

Advantageously, the slider of the invention further allows the lock mechanism of the sliding movement to be unlocked on command in a convenient and reliable manner over time.

In addition, the release button can be integrated in the slider in an aesthetically unobtrusive manner so that a good portion of the surface exposed to the outside of the slider body can be used for aesthetic purposes.

In certain cases, it is even possible to integrate the release button in the slider's own aesthetics so as to achieve an unusual aesthetic effect.

In the present description and in the subsequent claims, the term "body" means a single mechanical element made in a single piece or a plurality of parts made integral with each other in a reversible or irreversible manner.

The slider body slides along a zip fastener in a longitudinal direction. This longitudinal direction is the main reference axis for the elements forming part of the slider according to the present invention; indications of directions such as "longitudinal" and "longitudinally" will be referred thereto.

The slider body is configured to couple two teeth arrays of a zip fastener in a specific side-by-side configuration. This side-by-side arrangement identifies a horizontal plane parallel to the longitudinal direction. With reference to the longitudinal direction, the terms "forward" and "advanced" refer to the direction along which the movement of the slider closes the zip fastener. Similarly, terms such as "backward" and "retracted" refer to the direction along which the movement of the slider opens the zip fastener.

A vertical axis is defined as an axis perpendicular to the aforesaid horizontal plane and to the aforesaid longitudinal direction. The spatial references such as "vertical", "vertically", "above", "upper", "below", "lower" will be defined with respect to the latter.

A transverse axis is defined as perpendicular to the longitudinal axis and to the vertical axis. The spatial references such as "transversal", "transversely", "lateral", "laterally" will be defined with respect to these axes.

The present invention may have one or more of the preferred features described in the following detailed description. In particular, these preferred features can be combined with each other at will according to application needs.

Figure 1:
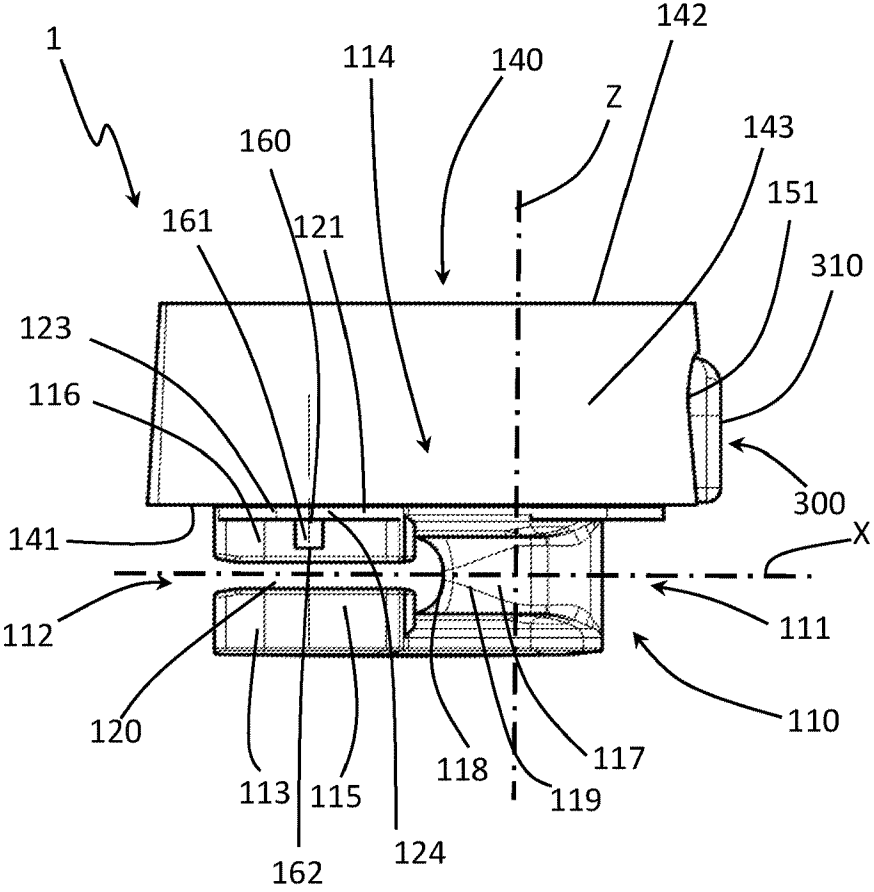
Figure 4:
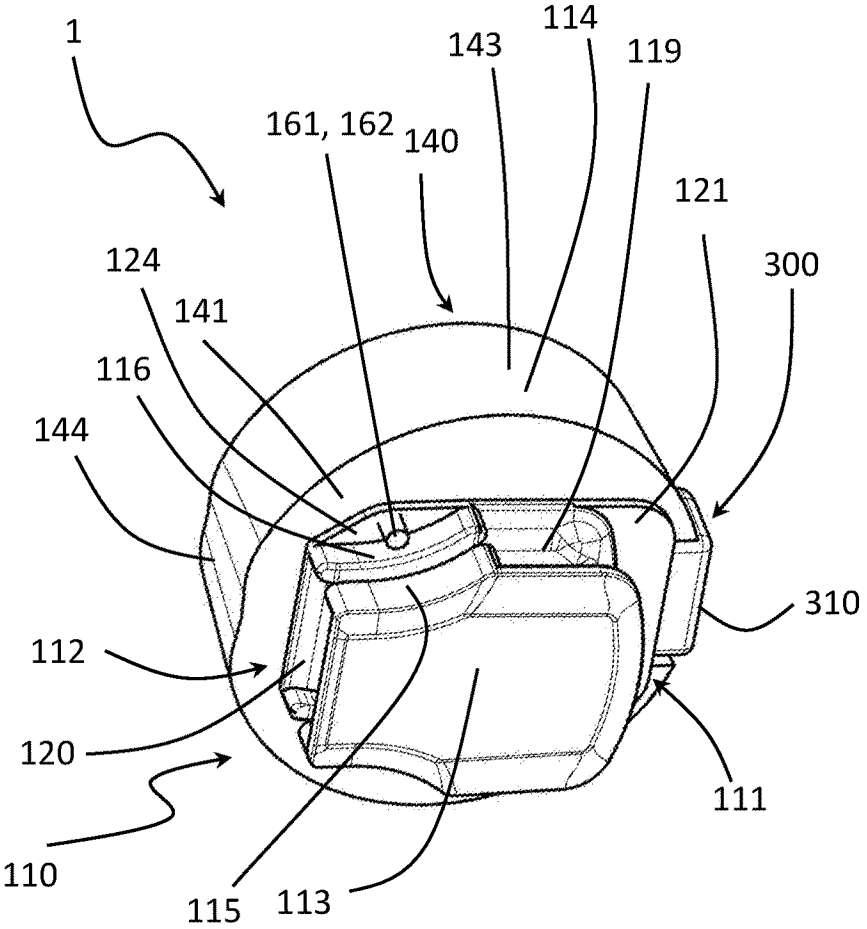
Figure 3:
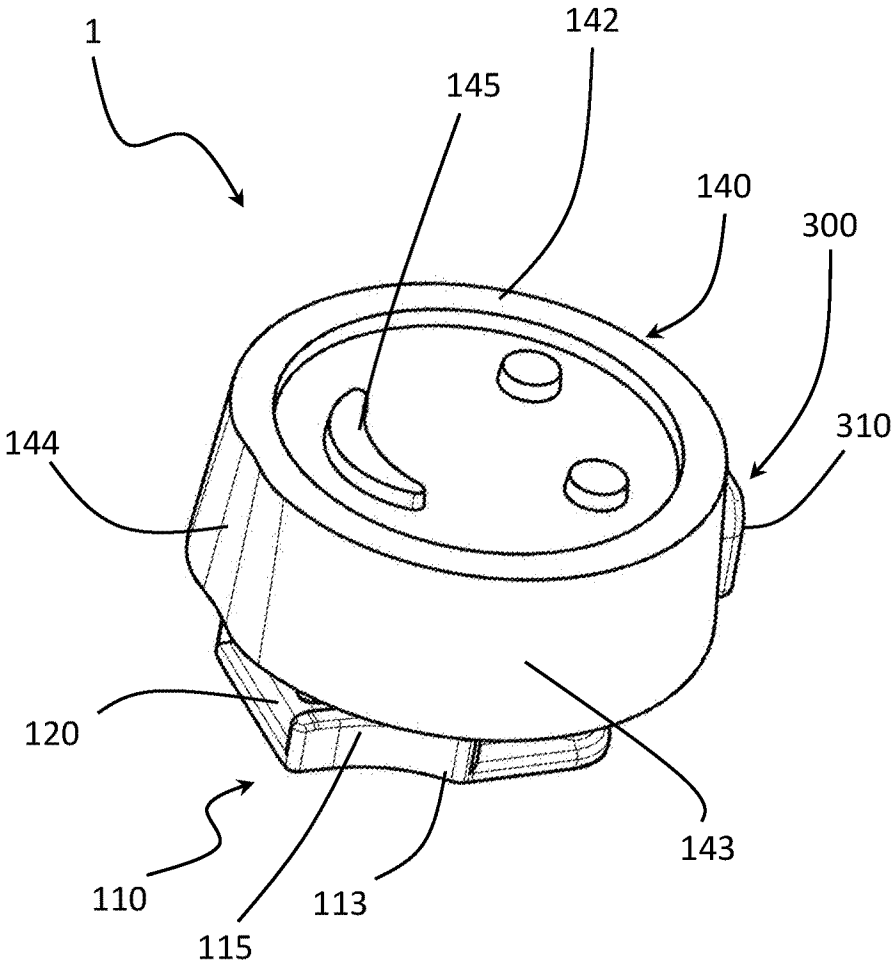
Figure 5:
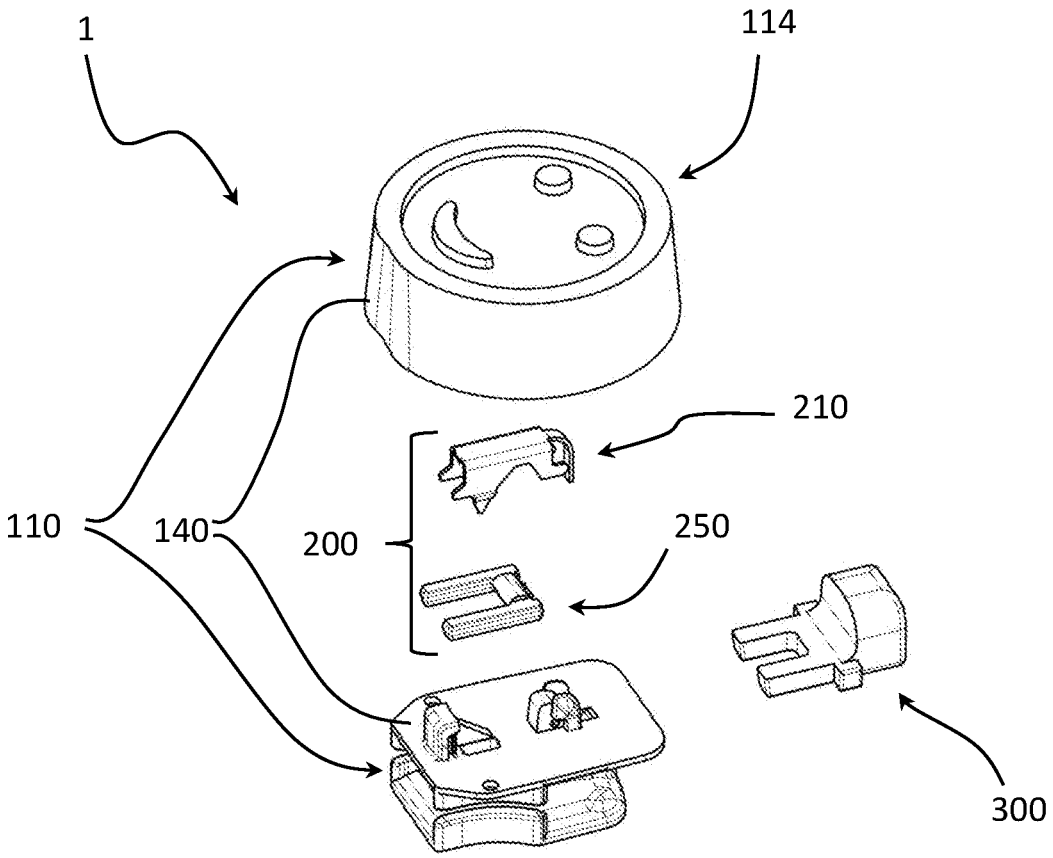
Figure 6:
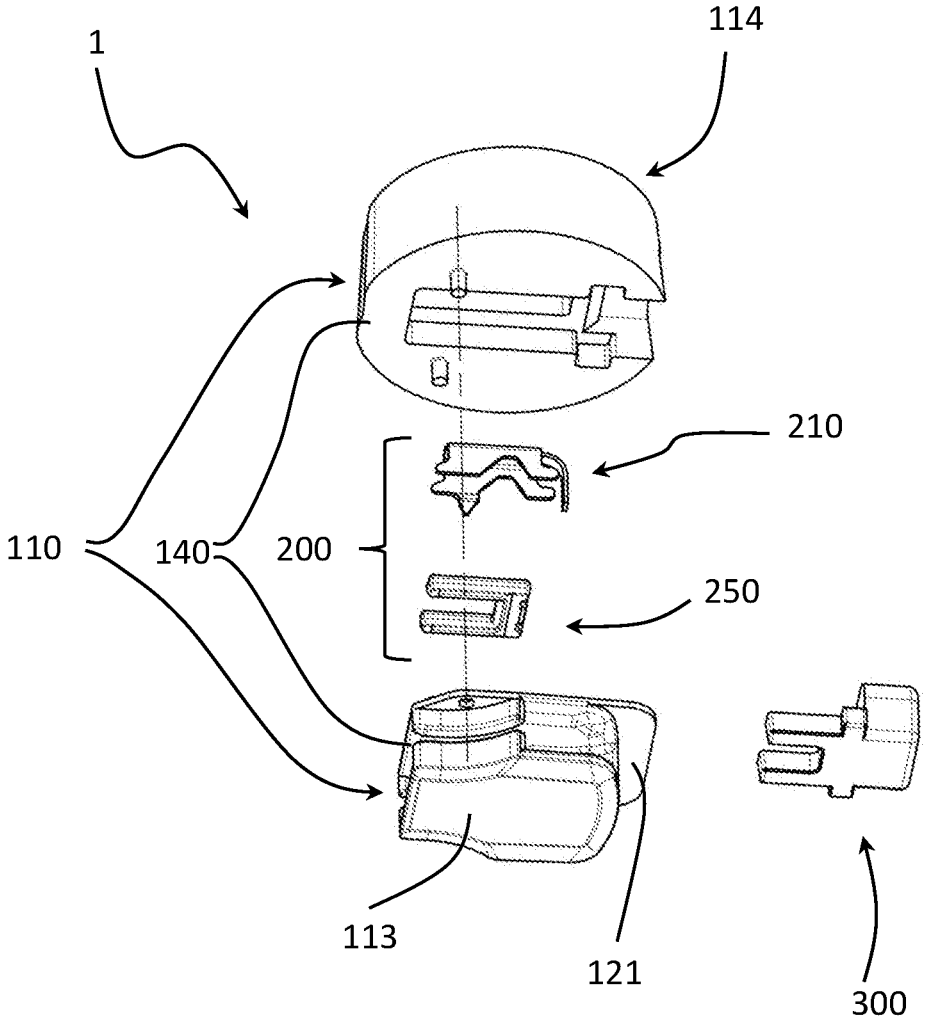
Figure 10:
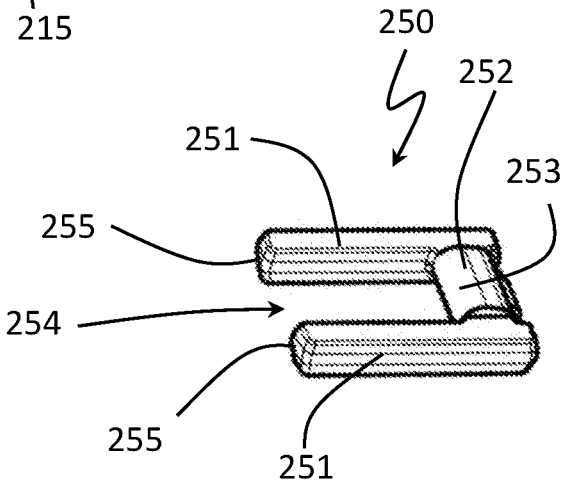
Figure 11:
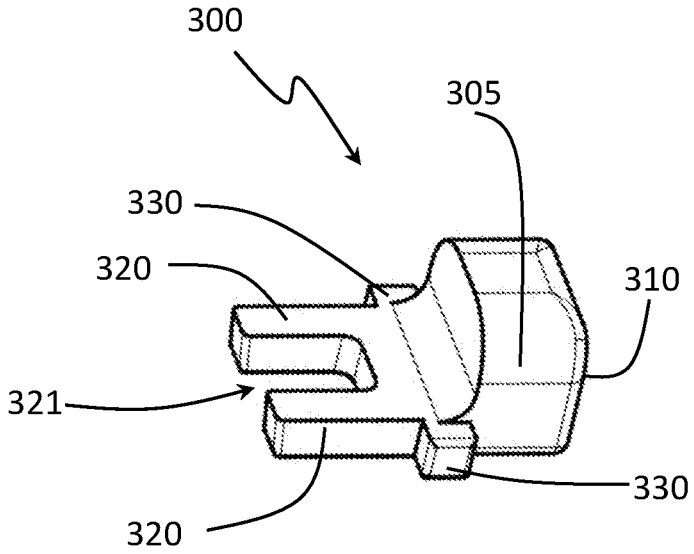
Figure 12:
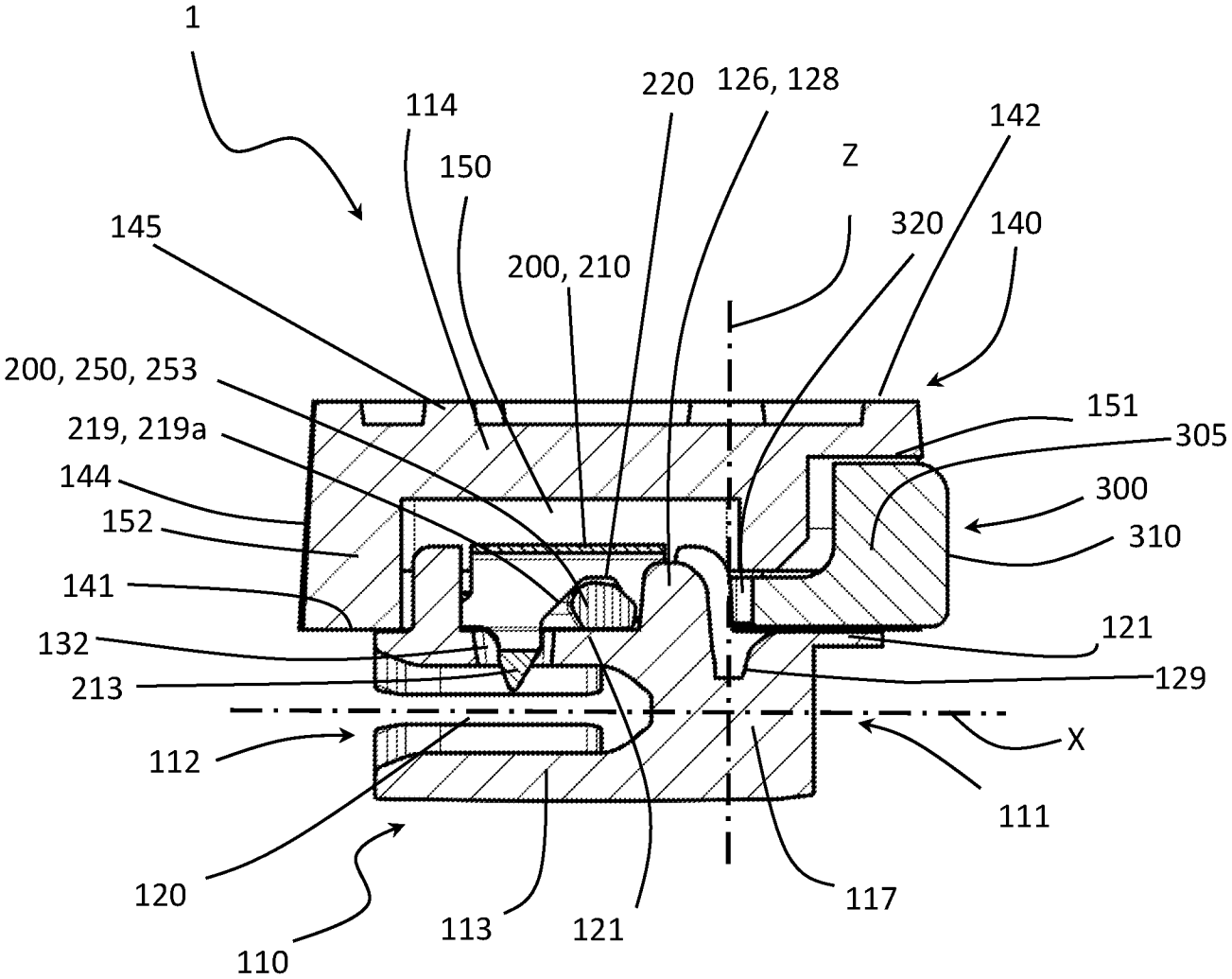
Figure 13:
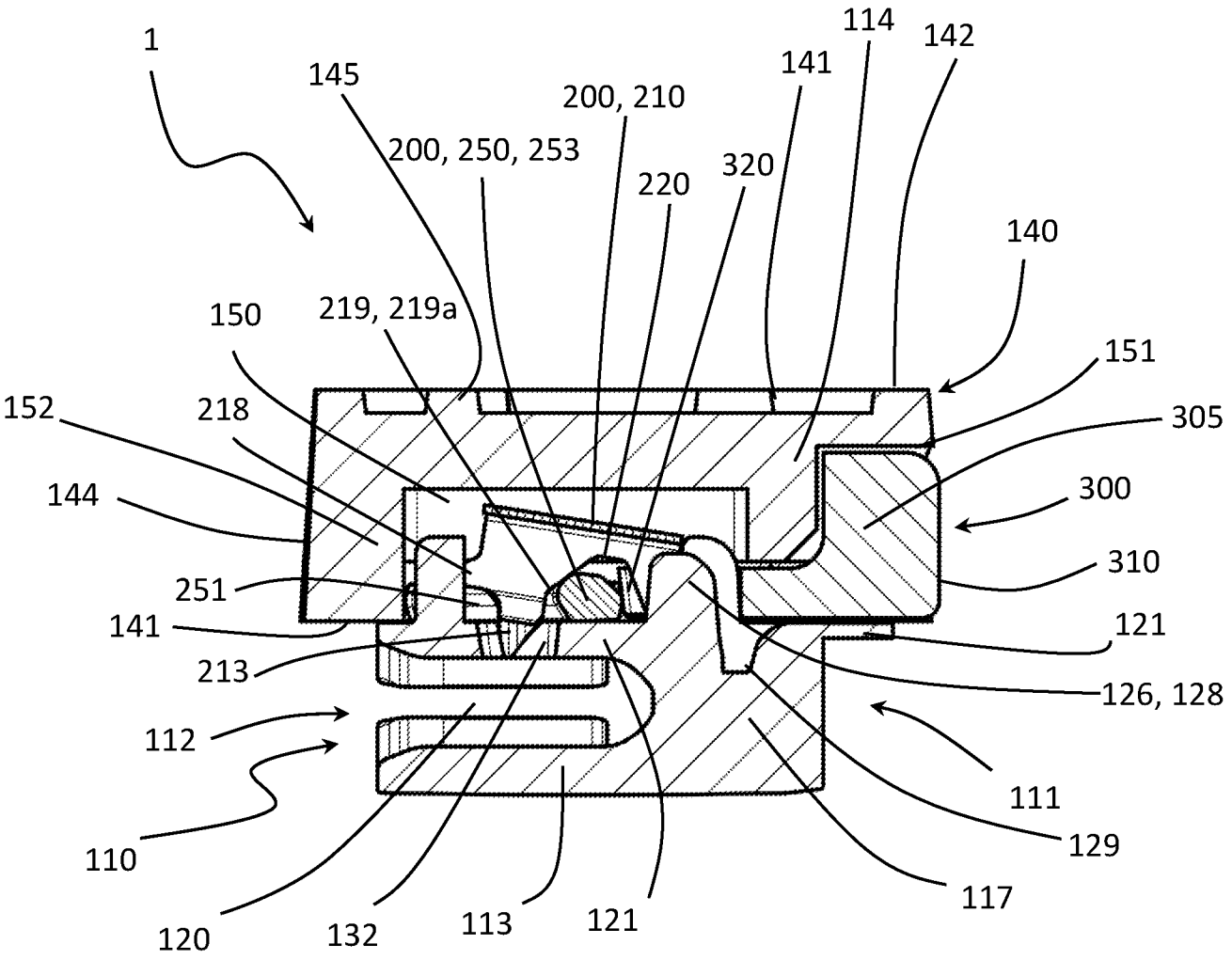

Additional features and advantages of the present invention will be more clearly apparent from the following detailed description of a possible preferred embodiment, illustrated by way of non-limiting example in the accompanying drawings, wherein:

FIG. 1 shows a side view of a slider for zip fasteners according to the present invention, FIG. 2 shows a bottom view of the slider of FIG. 1, FIGS. 3 and 4 show respective perspective views, from above and below, of the slider of FIG. 1, FIGS. 5 and 6 show respective exploded perspective views, from above and below, of the slider of FIG. 1, FIGS. 7 to 11 show respective perspective views of components of the slider of FIG. 1, FIGS. 12 and 13 show sectional views of respective operative configurations of the slider of FIG. 1.

A slider for zip fasteners according to a preferred embodiment of the present invention is indicated with the numerical reference 1 in the appended figures.

According to the invention, the slider 1 illustrated in the accompanying figures is of the so-called "self-locking" type.

Figure 8:
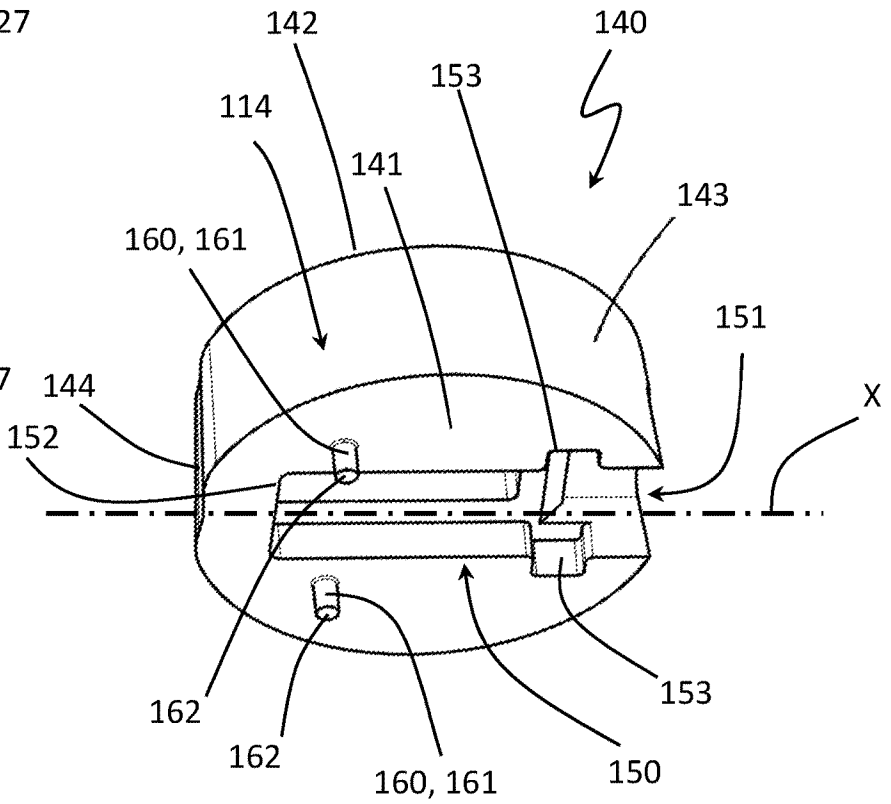
Figure 7:
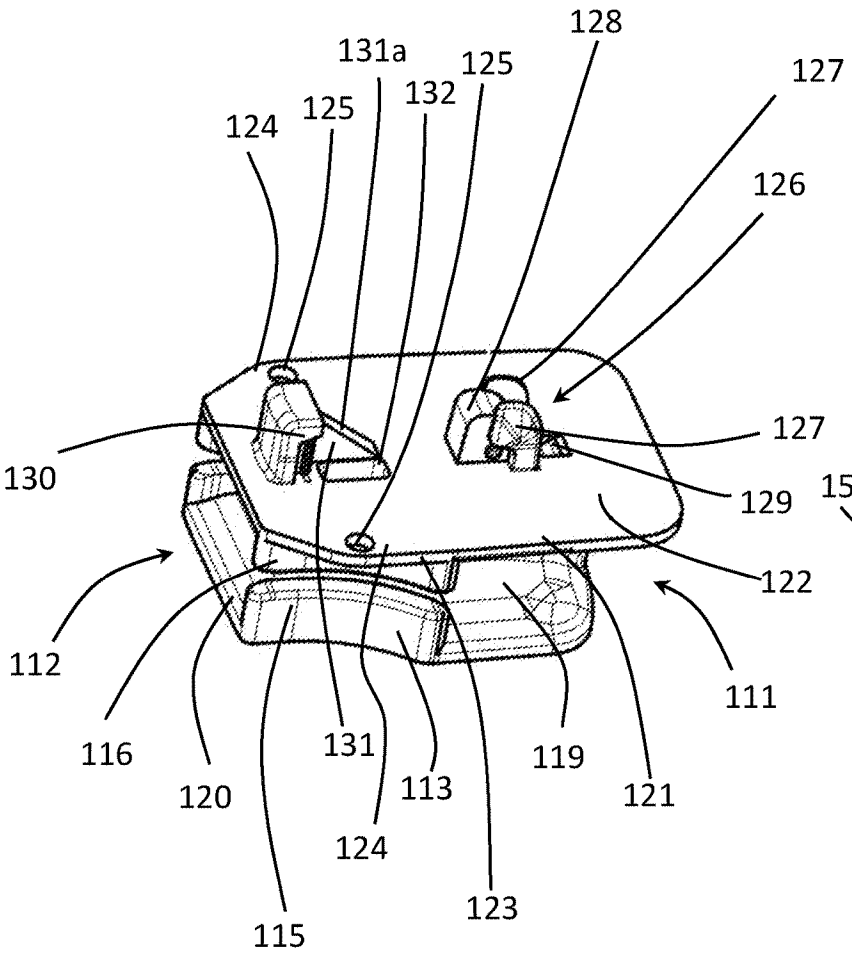

The slider 1 comprises a slider body 110, illustrated in more detail in FIGS. 7 and 8, comprising a first end 111 at which two longitudinal slide channels 119 for teeth of a zip fastener open and a second end 112 at which a single longitudinal sliding channel 120 for the teeth of a zip fastener opens.

In a way known per se, the two channels 119 join in the single channel 120 in the slider body 110.

The slider body 110 is configured to longitudinally slide along two rows of teeth of a zip fastener. The longitudinal direction is indicated in the attached figures by the X axis.

The slider body 110 longitudinally extends from the first end 111 to the second end 112 and comprises a lower portion 113 and an upper portion 140 that is opposite to the lower portion 113 along a vertical direction (see for example, FIGS. 1, 3 and 4).

The vertical direction is orthogonal to the longitudinal direction and is indicated in the attached figures by the Z axis.

The lower portion 113 and the upper portion 140 both extend from the first end 111 to the second end 112.

The lower portion 113 comprises a pair of vertically extending lower lateral flanges 115. The upper portion 140 comprises a pair of upper lateral flanges 116 vertically extending towards the lower lateral flanges 115.

A nose portion 117 connects the lower portion 113 to the upper portion 140 (see for example FIGS. 1, 12 and 13).

The nose portion 117 is arranged between the upper portion 140 and the lower portion 113 and longitudinally extends from the first end 111 to an intermediate point 118 between the first end 111 and the second end 112.

The two longitudinal sliding channels 119 open on the first end 111, each sliding channel 119 being configured to receive a single array of teeth of the zip fastener. The two channels 119 are inferiorly delimited by the lower portion 113 and superiorly delimited by the upper portion 140. The nose portion 117 laterally separates the two channels 119.

Each of the two channels 119 is delimited, at the opposite side with respect to the nose portion 117, by one of the lower lateral flanges 115 of the lower portion 113 and by one of the upper lateral flanges 116 of the upper portion 140 of the slider body 110.

In this way, each gap between the lower side flange 115 and the upper side flange 116 can be traversed by a piece of fabric of the zip fastener on which the array of teeth sliding in the channel 119 is installed.

The two channels 119 longitudinally extend from the first end 111 towards the second end 112 and converge into the intermediate point 118.

The single longitudinal sliding channel 120 for the two arrays of teeth of the zip fastener opens on the second end 112. The single channel 120 extends from the second end 112 towards the first end 111 until it joins with the two channels 119 at the intermediate point 118.

The single channel 120 is thus inferiorly delimited by the lower portion 113, superiorly delimited by the upper portion 140 and laterally delimited by the lower lateral flanges 115 and by the upper lateral flanges 116.

The slider body 110 is therefore internally provided with a cavity formed by the two channels 119 and by the single channel 120 which join at the intermediate point 118.

The slider body 110 can be mounted in a zip fastener (not illustrated) so that the two arrays of teeth of the zip fastener go through the single channel 120 and each array goes through one of the two channels 119.

The lower portion 113 is configured to be arranged at a side of the zip fastener that is, in use, unexposed or concealed, for example the inner side of an article, such as an item of clothing or footwear.

On the other hand, the upper portion 140 is configured to be arranged at a side of the zip fastener that is, in use, exposed or otherwise visible, for example the outer side of the article.

By sliding the slider body 110 along a first longitudinal sliding direction, the two rows of teeth converge into the point where the two channels 119 converge into the single channel 120 and couple to each other in such a way that the teeth of one row fit between the teeth of the other row, closing the zip fastener.

By sliding the slider body 110 in a second longitudinal sliding direction that is opposite to the first one, the two mutually coupled rows of teeth enter the single channel 120 and are split near the intermediate point 118 of the slider body 110 where the single channel 120 splits in two, causing the zip to open.

Preferably, the upper portion 140 comprises a support base 121, integrally connected by means of the nose portion 117 with the lower portion 113 of the slider body 110, and a protruding element 114 vertically extending from the support base 121.

The support base 121 and the protruding element 114 are therefore facing upwards, i.e., towards the outside of the slider 1 in the conditions of use in a zip fastener.

Preferably, the support base 121 is configured to support the protruding element 114.

To this end, the support base 121 is preferably substantially plate-like and has an upper face 122, perpendicular to the vertical direction and a side wall 123 (see FIG. 7).

Preferably, the side wall 123 is vertical.

Preferably, the support base 121 defines with the lower portion 113 of the slider body 110 a plurality of fins, for example a pair of fins 124, laterally extending at the second end 112 of the slider body 110 (see FIGS. 2 and 4).

Preferably, the fins 124 are integral with the support base 121 so that they laterally extend from the slider body 110 in a plane perpendicular to the vertical direction.

In this preferred embodiment, therefore, each fin 124 comprises an upper face forming part of the upper face 122 of the support base 121 and a side wall forming part of the side wall 123 of the support base 121.

In the preferred embodiment illustrated, the fins 124 are arranged at opposite sides of the support base 121 with respect to the X axis.

Preferably, the support base 121 has a plurality of holes 125 made in the fins 124.

In particular, at least two fins 124 each have at least one hole 125.

Advantageously, the holes 125 made in the fins 124 can be easily made and accessible.

Preferably, the holes 125 extend in a vertical direction and are through holes, i.e., extending through the entire vertical extension of the respective fin 124.

Preferably, the protruding element 114 of the upper portion 140 of the slider body 110 is structurally independent from the support base 121 and is mechanically rigidly fixed, reversibly or, more preferably, irreversibly, to the support base 121.

As illustrated above, in this preferred embodiment of the slider 1 the protruding element 114 always remains exposed towards the outside of the slider of the zip fastener 1 to achieve, for example, a desired aesthetic effect.

Within the framework of the present description and of the subsequent claims, the expression "mechanically and rigidly coupling" and the like means that the protruding element 114 of the upper portion 140 of the slider body is coupled to the remaining portion of the slider body 110 by means of operations of mechanical interaction of parts, for example by plastic deformation.

In this sense, therefore, there is a mechanical and rigid coupling of parts without glues or adhesives being used.

In this way, the slider body 110 and the protruding element 114 can each be made according to the most suitable production process. The slider body 110 can be made by means of the production process that is best suited to its shape and its mechanical requirements, for example by moulding, and the protruding element 114 can be made by means of the most economical and flexible production process, which allows to easily modify the shape and the aesthetic appearance, for example by moulding or by one or more mechanical machining operations with chip removal.

Preferably, the protruding element 114 is mechanically fixed in a rigid and preferably irreversible manner, to the support base 121 for example and preferably by means of a coupling assembly 160 which will be described in more detail below.

Preferably, the protruding element 114 has a lower face 141 abutting against the support base 121 (see FIG. 8).

Preferably, the protruding element 114 has an upper face 142 opposite to the lower face 141 along a vertical direction.

Preferably, the protruding element 114 of the upper portion 140 of the slider body 110 is provided with a side wall 143 extending from the lower face 141 to the upper face 142.

In the preferred embodiment, the side wall 143 of the protruding element 114 and, thus of the upper portion 140 of the slider body 110, has a substantially cylindrical or frusto-conical shape and is oriented along a substantially vertical or slightly oblique direction with respect to the vertical direction.

Preferably, the side wall 143 of the upper portion 140 of the slider body 110 comprises a pressure portion 144 suitably shaped to allow a finger of the user to be placed thereon and to allow the user to exert a longitudinally directed pressure on the slider body 110 and in a direction opposite to the opening direction of the zip fastener.

Preferably, the pressure portion 144 of the upper portion 140 of the slider body 110 is configured to allow the ergonomic positioning thereon of a finger of the user so as to exert on the upper portion 140 and, specifically, on the protruding element 114 thereof, a force that is directed substantially perpendicularly to the pressure portion 144.

"Ergonomic positioning" means that at least 10% of the fingertip can adhere to the pressure portion 144 while exerting this force, preferably at least 20%. Still more preferably at least 30%.

Preferably, the pressure portion 144 is substantially perpendicularly oriented to the longitudinal sliding direction of the slider 1.

Preferably, the pressure portion 144 has a flat or concave region configured to best accommodate a finger of the user (e.g., the thumb or the index finger).

In the preferred embodiment illustrated, the pressure portion 144 is part of the side wall 143.

In a preferred embodiment, the protruding element 114 of the upper portion 140 of the slider body 110 comprises a decorative element 145, for example, a logo, or it is itself configured as a three-dimensional decorative element.

In the preferred embodiment illustrated in the figures, said decorative pattern 145 is applied at the upper wall 142 of the protruding element 114 so that in the use configuration of the slider 1 said decorative pattern 145 may be facing outwards with respect to the article on which the slider 1 is applied, so as to be easily visible.

Preferably, the protruding element 114 has a geometric three-dimensional shape, such that the protruding element 114 as a whole has at least a dimension substantially of the same order of magnitude as the lower portion 113 of the slider body 110.

In the preferred embodiment illustrated in the figures, the protruding element 114 has a dimension greater than that of the lower portion 113 of the slider body 110.

In this way, it is advantageously possible to achieve the most varied aesthetic characteristics of the slider 1 as a whole.

Preferably, the protruding element 114 completely covers the support base 121 of the upper portion 140 of the slider body 110.

In other words, the protruding element 114 is advantageously configured to cover the slider body 110 when the latter is applied on a zip fastener of an article, so as to expose the decorative pattern 145 instead of the slider body 110 and of other functional components of the slider 1.

As illustrated above, the slider 1 preferably comprises a coupling assembly 160 configured to mechanically and rigidly couple, preferably irreversibly, the protruding element 114 to the support base 121 of the upper portion 140 of the slider body 110.

Preferably, the coupling assembly 160 acts between the lower face 141 of the protruding element 114 and the support base 121 of the slider body 110 to clamp them against each other.

Preferably, the coupling assembly 160 is configured to mechanically couple the protruding element 114 to the support base 121 of the slider body 110 at the fins 124 described above and defined by the support base 121 with the lower portion 113 of the slider body 110.

In this way, it is advantageously possible to have an easy access to the part of the slider 1 where the coupling assembly 160 acts.

Preferably, the coupling assembly 160 comprises a plurality of pegs each configured to engage a respective housing hole.

In the figures, the pegs of the coupling assembly 160 are indicated by reference 161.

In preferred embodiments, the pegs 161 may integrally extend from one among the slider body 110 and the protruding element 114 and respective housing holes made in the other among the slider body 110 and the protruding element 114.

The pegs 161 and the holes can be made on the support base 121 of the upper portion 140 of the slider body 110 and on the protruding element 114 after they have been made and independently of the mechanical operations adopted to produce them.

Preferably, the pegs 161 are mechanically fixed to the other among the support base 121 of the slider body 110 and the protruding element 114 in an irreversible manner, for example by plastic deformation in the respective housing holes.

The plastic deformation of the pegs allows a rigid and irreversible coupling between the protruding element 114 and the remaining part of the slider body 110, which is able both to guarantee the required strength and rigidity and to ensure that the protruding element 114 is stably an integral part of the upper portion 140 of the slider body 110 over time.

In the preferred embodiment illustrated in the figures, the pegs 161 are integral with the protruding element 114 and protrude from the lower face 141 of said protruding element 114.

In the preferred embodiment illustrated in the figures, the holes 125 are through holes formed in the fins 124, while the pegs 161 are mechanically fixed to the slider body 110 by plastic deformation of a respective free end portion 162 thereof protruding from the through holes 125.

When making the preferred embodiment of the slider 1 illustrated in the figures, it is therefore sufficient to arrange the protruding element 114 and the support base 121 of the slider body 110 next to each other and subsequently to deform the free end portion 162 of the pegs 161.

In an alternative preferred embodiment, the pegs 161 may be mechanically fixed to the slider body 110 in an irreversible manner by plastic deformation of a free end portion 162 of the pegs 161 within the through holes 125.

In other words, according to this preferred embodiment of the invention, the pegs 161 are subjected to an irreversible mechanical deformation subsequent to their insertion inside the holes 125 so as to irreversibly engage the slider body 110.

According to an alternative preferred embodiment, not illustrated, the holes 125 are blind holes whereas the pegs 161 are plastically deformed inside the holes 125.

In both of the aforesaid coupling modes, each peg 161 cannot therefore disengage from the hole 125 unless there are structural breakages or failures.

According to an alternative embodiment, the pegs 161 are coupled by interference to the respective holes 125.

In this case, each peg 161 has a larger cross-sectional area than the respective hole 125 and is inserted therein thanks to a temperature difference with the hole 125 which reduces its relative dimension. The natural reduction in temperature difference normalises the dimensions of the peg 161 and of the hole 125 and makes their mutual engagement irreversible.

According to a non-illustrated embodiment, the coupling assembly 160 comprises pegs that protrude from the support base 121 to engage respective holes made in the protruding element 114.

According to an embodiment not illustrated, the coupling assembly 160 comprises a plurality of threaded members, which go through respective through holes 125 made in the support base 121, and in screwing engagement in respective further holes, preferably blind holes, made in the protruding element 114.

Preferably, such threaded members consist of screws.

The aforesaid further holes may have a nut screw configured to couple with the threaded members.

Alternatively, the threaded members may comprise self-tapping screws in order to establish a threaded coupling with the further holes lacking a nut screw.

The through holes 125 can be made at the fins 124 in a similar manner as described and illustrated above.

This allows an access to the screw heads from below.

Preferably, the threaded coupling between the threaded members and the further holes is irreversible. The irreversibility can be obtained by means of a subsequent mechanical processing on the head of the screw or on the insert thereof so that unscrewing is made impossible.

According to the invention and as illustrated above, the slider 1 comprises a lock mechanism 200 of the sliding movement of the slider 1 that is positioned in the slider body 110 and comprising a movable stop element 210 of the sliding movement of the slider 1 in a longitudinal direction and in the zip fastener opening direction and illustrated in greater detail below with reference to FIGS. 7 and 9.

According to the invention, the slider 1 further comprises a release button 300 for unlocking the lock mechanism 200, slidably mounted in the slider body 110 and manually operable to unlock the lock mechanism 200.

The release button 300 is in particular configured to cooperate with the movable stop element 210 of the lock mechanism 200 and to move the movable stop element 210 from an operative position (illustrated in FIG. 12), wherein the movable stop element 210 engages one of the channels 119; 120 for locking a slider 1 sliding along the opening direction of the zip fastener, to a non-operative position (illustrated in FIG. 13) wherein the movable stop element 210 does not engage any of the aforesaid channels 119; 120.

Preferably, the release button 300 is mounted in the upper portion 140 of the slider body 110, more preferably in the protruding element 114 of the upper portion 140, at a longitudinally opposite part with respect to the above-described pressure portion 144 of the upper portion 140 (see FIGS. 12 and 13).

In this way, it is advantageously possible to manually grasp in a very easy way the upper portion 140 of the slider body 110, specifically the protruding element 114 thereof, and to exert in an equally easy way such an action of manual pressure which allows to operate—only when desired—the release button 300.

In order to optimise such a technically advantageous effect and as best illustrated in FIGS. 12 and 13, the release button 300 preferably comprises a respective pressure portion 310, and is configured such that the pressure portion 144 of the side wall 143 of the upper portion 140 of the slider body 110, specifically of the protruding element 114 thereof, and the pressure portion 310 of the release button 300 are aligned along a longitudinal sliding direction of the slider body 110.

In the preferred embodiment illustrated, the protruding element 114 of the upper portion 140 of the slider body 110 comprises a cavity 150 formed above the support base 121 and configured to at least partially house the lock mechanism 200 of the sliding of the slider 1 (see FIG. 8).

In this way, it is advantageously possible both to protect the lock mechanism 200 while preserving as much as possible its proper functioning, and to conceal said lock mechanism 200 from view while preserving the aesthetic characteristics conferred to the slider 1 by the upper portion 140 of the slider body 110, in this case by the protruding element 114 thereof.

More specifically, the cavity 150 is made in the lower part of the protruding element 114 so as to open in the lower surface 141.

Preferably, the cavity 150 extends in the longitudinal direction.

Preferably, the release button 300 is partially housed in said cavity 150 so that the respective pressure portion 310 protrudes from a driving opening 151 provided in the protruding element 114 of the upper portion 140 of the slider body 110.

In this way, it is advantageously possible both to protect the release button 300 from damages and to have available as needed the part of said release button 300 that must be pressed manually to unlock the lock mechanism 200 minimising, if not eliminating, the possibility of an accidental operation.

Preferably, the driving opening 151 opens into the cavity 150.

Preferably, the driving opening 151 is made in the side wall 143 of the protruding element 114, in particular at a position opposite to the pressure portion 144.

Preferably, the driving opening 151 is located at a longitudinal end of the cavity 150.

Preferably, the cavity 150 is longitudinally delimited by a rear wall 152 opposite to the driving opening 151.

Preferably, the pressure portion 144 is arranged at the rear wall 152 at an opposite side with respect to the cavity 150.

Preferably, the release button 300 protrudes from the driving opening 151 for a length lower than 6 mm, preferably said length being comprised between 0.5 mm and 5 mm and still more preferably between 1 mm and 4 mm.

In this way, it is possible to optimise the technical effects described above of protecting the lock mechanism 200 and of reducing the possibility of an unintentional operation to the benefit of the operating reliability of the slider 1.

In the preferred embodiment illustrated, the cavity 150 formed in the upper portion 140 of the slider body 110, in this case in the protruding element 114 thereof, is configured to guide a sliding, preferably longitudinal, of the release button 300 in the upper portion 140 of the slider body 110.

In this way, it is advantageously possible to guide in a protected manner the release button 300 while ensuring an optimal operating reliability of the slider 1.

In the preferred embodiment illustrated, the cavity 150 comprises at least one lateral recess 153, more preferably two lateral recesses 153, extending in a transverse direction at opposite sides with respect to the longitudinal X axis (see FIG. 8).

The transverse direction is orthogonal to the longitudinal direction and to the vertical direction and is indicated in the attached figures by the Y axis.

In the preferred embodiment illustrated, the cavity 150 provided with the lateral recesses 153 has substantially an elongated cross shape.

In the preferred embodiment illustrated in the attached figures and for a greater sliding stability, the release button 300 comprises at least one lateral protrusion 330, more preferably two lateral protrusions 330, extending in opposite directions perpendicular to the longitudinal direction, each inserted into a respective lateral recess 153 of the cavity 150 (see FIG. 11).

In this way, an end-stop of the release button 300 is advantageously defined in the upper portion 140 of the slider body 110.

In other words, each lateral protrusion 330 is movable in its respective lateral recess 153 when the release button 300 moves between a non-operative position thereof and an operative, or pressed, position thereof and is configured to abut against a wall of the lateral recess 153 when the release button 300 reaches the non-operative position.

This also advantageously limits the maximum excursion of the release button 300 in the slider body 110 and prevents the release button 300 from completely exiting from the cavity 150.

As can be seen from the figures, in this preferred embodiment, the protruding element 114 is moved close to the support base 121 of the upper portion 140 of the slider body 110 in the assembly phase of the slider 1 so as to partially occlude the cavity 150.

In this way, the components to be housed in the cavity can be inserted therein before the coupling of the protruding element 114 to the support base 121 of the slider body 110 and, subsequently, the coupling of the protruding element 114 to said support base 121 partially occludes the cavity 150, enclosing the various components of the slider 1 present therein.

Preferably, the support base 121 inferiorly occludes the cavity 150 so that, in the assembled configuration of the slider 1, the driving opening 151 is the only access to the cavity 150.

In the preferred embodiment illustrated, the lock mechanism 200 comprises a driving element 250 of the movable stop element 210, which will be described in more detail below with reference to FIG. 10, longitudinally interposed between the release button 300 and the movable stop element 210.

As will be described in more detail below, the driving element 250 is translationally driven along the longitudinal direction (i.e., along the X axis) by the release button 300.

In the preferred embodiment illustrated, the movable stop element 210 of the lock mechanism 200 of the sliding movement of the slider 1 is arranged on the support base 121 of the slider body 110.

As illustrated above, the movable stop element 210 may be driven by the release button 300 and is configured to stop the sliding of the slider 1 in the opening direction of the zip fastener and to prevent the unintentional opening of the latter.

Figure 9:
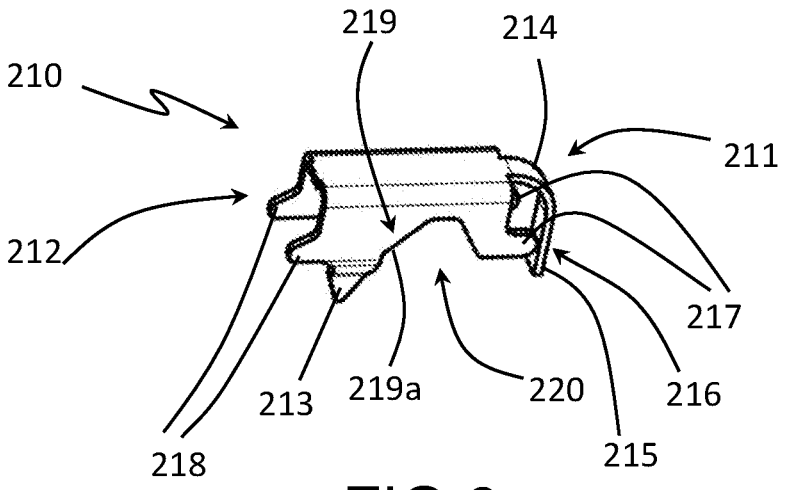

Preferably and as better illustrated in FIG. 9, the movable stop element 210 is substantially bridge-shaped and comprises:

i) a recess 220 configured to house an engagement portion 253 of the driving element 250; and ii) an abutment portion 219 engageable by the engagement portion 253.

Preferably, the engagement portion 253 of the driving element 250 is configured to cooperate with said abutment portion 219 to move the movable stop element 210 from its operative position to its non-operative position.

More particularly, the abutment portion 219 and the engagement portion 253 of the driving element 250 are configured to slide against each another so as to lift a second end 212 of the movable stop element 210 with respect to a first end 211 (and thus a rotation of the movable stop element 210) during the translation of the driving element 250 from an advanced position to a retracted position.

Preferably, the engagement portion 253 is configured to interpose between the abutment portion 219 and a ramp portion 131, extending from the support base 121 of the upper portion 140 of the slider body 110, and to move them away from each other during the translation of the driving element 250 from the advanced position to the retracted position.

In this way, it is advantageously possible to move the movable stop element 210 safely and reliably to its non-operative position by means of a guided translation of the release button 300 and of the driving element 250.

In the preferred embodiment illustrated, the abutment portion 219 of the movable stop element 210 has a sliding surface 219*a*, facing the longitudinal sliding channels 119, 120 of the teeth of the zip fastener and inclined with respect to the longitudinal direction.

Advantageously, this configuration of the movable stop element 210 facilitates its movement towards its non-operative position by the release button 300 and the driving element 250.

To optimise such a movement, the engagement portion 253 of the driving element 250 is preferably configured to slide against the sliding surface 219*a* during a longitudinal translation of the engagement portion 253 towards the second end 112 of the slider body 110 along the X axis so as to effectively move the movable stop element 210 from its operative position to its non-operative position.

Advantageously, such a movement of the movable stop element 210, is further optimised by the ramp portion 131 extending from the support base 121 of the upper portion 140 of the slider body 110.

Advantageously, the ramp portion 131 guides along a vertical direction the displacement of the engagement portion 253 of the driving element 250 away from the support base 121 of the slider body 110.

Preferably, the engagement portion 253 of the driving element 250 is configured to slide against the ramp portion 131 so as to move away from the support base 121 during a longitudinal translation along the X axis of the driving element 250 towards the second end 112 of the slider body 110 (i.e., in the opening direction of the zip fastener).

In this way, the reliability and the repeatability of movement of the movable stop element 210 are advantageously optimised.

In the preferred embodiment illustrated, the recess 220 of the movable stop element 210 defines a through opening between the movable stop element 210 and the support base 121 of the upper portion 140 of the slider body 110.

In this preferred embodiment, the engagement portion 253 of the driving element 250 configured to move the movable stop element 210 is conveniently housed in this through opening.

Preferably, the recess 220 is formed in the body of the movable stop element 210 adjacent to the abutment portion 219 and is longitudinally interposed between at least one hooking portion 217 of the movable stop element 210 to the slider body 110 and the abutment portion 219 (see FIG. 9).

In the preferred embodiment illustrated, the movable stop element 210 extends from a first end 211 to a second end 212 opposite to the first end 211 and further comprises:

iii) a stop tooth 213 formed at the second end 212 and configured to engage one of the longitudinal sliding channels 119; 120 of the teeth of the zip fastener when the movable stop element 210 is in its operative position (illustrated in FIG. 12), iv) an elastic portion 214 formed at the first end 211 and configured to push the movable stop element 210 towards its operative position (again illustrated in FIG. 12).

Preferably, in the assembled configuration of the slider 1 the stop tooth 213 extends in a substantially vertical downward direction. In the locking position of the slider 1 (corresponding to the operative position of the movable stop element 210), the stop tooth 213 of the movable stop element 210 engages the channel 119; 120 through a through hole 132 made in the support base 121 so as to prevent a sliding of the slider 1 on the zip fastener along at least one longitudinal direction.

Preferably, the through hole 132 is configured to house the aforesaid stop tooth 213 of the movable stop element 210.

Preferably, the through hole 132 vertically extends from the support base 121 towards one of the channels 119, 120, in this case towards the channel 120.

Preferably, the through hole 132 is placed aside the ramp portion 131. In particular, the stop tooth 213 in the locking position is configured to prevent a backward sliding of the slider 1 and to allow a forward sliding of the slider 1 i.e., in the opening direction of the zip fastener.

In a preferred embodiment, the stop tooth 213 of the movable stop element 210 is also configured not to prevent a forward sliding of the slider 1, that is, in the closing direction of the zip fastener. This, thanks to a particular geometric shape of the tooth itself, as known to those skilled in the art.

In this way, the slider 1 can be advantageously moved in the zip closing direction without necessarily having to actuate the release button 300, thus increasing the ease of use of the slider 1.

In the preferred embodiment illustrated, the driving element 250 is substantially U-shaped and comprises two longitudinally extending arms 251 substantially parallel to each other, and a joining section 252 extending between said parallel arms 251.

Preferably, the engagement portion 253 of the driving element 250 is arranged at said joining section 252.

This preferred configuration of the driving element 250 is particularly effective in ensuring a reliable movement of the movable stop element 210 taking into account its preferred fixing configuration to the slider body 110 as described in more detail hereinbelow.

Specifically, the slider body 110 preferably comprises a first coupling portion 126 of the movable stop element 210 to the slider body 110 protruding from the support base 121 of the upper portion 140 of the slider body 110 next to the first end 111 of the slider body.

Preferably, the first coupling portion 126 protrudes upwards, i.e., substantially perpendicularly to the support base 121 itself.

Preferably, the first coupling portion 126 comprises at least one first hooking portion 127, preferably two first hooking portions 127, protruding from the support base 121 and defining at least one housing seat 126 of the aforementioned hooking portion 217 formed at one end of the movable stop element 210, preferably a pair of housing seats for a pair of hooking portions 217 (see FIG. 9), the operation of which will be described in detail hereinbelow.

Preferably, the first coupling portion 126 of the slider body 110 comprises a retaining portion 128 at the at least one first hooking portion 127, preferably protruding from the support base 121 between the two first hooking portions 127.

Preferably, the slider body 110 comprises a cavity 129 formed in the support base 121 adjacent to the first coupling portion 126.

Preferably, the slider body 110 also comprises at least one first stop portion 130 for stopping the movable stop element 210, preferably two first stop portions 130, protruding from the support base 121 in a position that is longitudinally opposite to the first coupling portion 126 (see FIG. 7).

Advantageously, the first stop portions 130 are configured to limit the lifting movement of the movable stop element 210 with respect to the support base 121 of the slider body 110 (i.e., the movement of the movable stop element 210 towards its non-operative position illustrated in FIG. 13).

Preferably, the ramp portion 131 described above protrudes from the support base 121 of the upper portion 140 of the slider body 110 between the at least one first hooking portion 127 and the at least one first stop portion 130 (see FIG. 7).

Preferably, the ramp portion 131 comprises a sliding surface 131*a* obliquely oriented with respect to the upper face 122 of the support base 121 to define an inclined sliding track (i.e., for lifting) in a longitudinal and backward direction (i.e., in the direction from the first end 111 towards the second end 112 that corresponds to the opening direction of the zip fastener).

Preferably, the through hole 132 for housing the stop tooth 213 is arranged at the first stop portion 130 of the movable stop element 210.

In the preferred embodiment illustrated and as explained above, the movable stop element 210 is maintained in its operative position by the action of its elastic portion 214 which exerts a force directed to push the stop tooth 213 towards one of the channels 119, 120, in particular towards the single channel 120, through the hole 132.

Preferably, the elastic portion 214 is an integral part of a suitably shaped coupling portion 216 and extends from the bridge-shaped structure of the movable stop element 210 at its first longitudinal end 211 (see FIG. 9).

In particular, the coupling portion 216 is configured to couple the movable stop element 210 to the first coupling portion 126 that is protruding from the support base 121 of the upper portion 140 of the slider body 110.

In the preferred embodiment illustrated, the elastic portion 214 is conveniently formed by a flexible curved portion, preferably made of spring steel, of the coupling portion 216, which portion joins the bridge-shaped structure of the movable stop element 210 with an abutment tooth 215 formed at a free end of the coupling portion 216.

Preferably, the elastic portion 214 is configured to surround and cooperate in abutment relationship with the retaining portion 128 of the first coupling portion 126 of the slider body 110 to associate the movable stop element 210 with the latter such that the elastic portion 214 develops an elastic force on the bridge-shaped structure of the movable stop element 210 which is directed to maintain the latter in its operative position illustrated in FIG. 12.

In this position, the stop tooth 213 is pushed towards one of the channels 119; 120, in particular towards the single channel 120 thanks to the cooperation of the elastic portion 214 with the coupling portion 126 that protrudes from the support base 121.

More particularly, thanks to such a cooperation, a rotation hinge is defined between the movable stop element 210 and the slider body 110 which is configured to allow a rotation of the movable stop element 210 with respect to the slider body 110 around a rotation axis substantially perpendicular to the sliding axis X of the slider 1.

Preferably, the first coupling portion 126 protruding from the support base 121 and the second coupling portion 216 of the movable stop element 210 are housed in the cavity 150 of the protruding element 114 of the upper portion 140 of the slider body 110.

In this way, as illustrated above, an advantageous protection is achieved of the mechanical components of the lock mechanism 200 which allow the rotation of the movable stop element 210 while preserving the operating reliability thereof over time.

In addition, the mechanical components of the lock mechanism 200 are also advantageously hidden from the user's view.

The movable stop element 210 is rotatable about the rotation axis of the rotation hinge with respect to the slider body 110 between its operative locking position of the sliding of the slider 1 (illustrated in FIG. 12) and its non-operative releasing position of the sliding of the slider 1 (illustrated in FIG. 13).

Preferably, the abutment tooth 215 of the movable stop element 210 engages the cavity 129 adjacent to the first coupling portion 126 to define a fixed abutment to the elastic portion 214.

Preferably, the coupling portion 216 of the movable stop element 210 further comprises at least a second hooking portion 217 formed at the first end 211 of the movable stop element 210 and preferably extending, in the mounting configuration of the slider 1, from the bridge-shaped structure of the movable stop element 210 towards the first end 111 of the slider body 110 (see FIGS. 9, 12 and 13).

The coupling portion 216 preferably comprises a pair of such second hooking portions 217.

Preferably, the elastic force developed thanks to the cooperation between the elastic portion 214 and the first coupling portion 126 that protrudes from the support base 121 is capable to keep the second hooking portions 217 of the movable stop element 210 within their own housing seats formed in the first hooking portions 127 of the slider body 110.

Preferably, the movable stop element 210 comprises at least one longitudinally extending projection 218, preferably a pair of longitudinally extending projections 218, arranged at its second end 212 (see FIG. 9).

Said projection 218 cooperates with the at least one first stop portion 130 of the slider body 110 protruding from the support base 121 to stop the rotation of the movable stop element 210 around the rotation axis of the rotation hinge.

Preferably, the movable stop element 210 comprises two projections 218, each of which cooperates with a respective first stop portion 130 of the slider body 110.

As illustrated above, the movable stop element 210 comprises an abutment portion 219.

Preferably, the abutment portion 219 is arranged between the at least one second hooking portion 217 and the at least one projection 218 (see FIG. 9).

Preferably, the abutment portion 219 is arranged at the ramp portion 131 of the slider body 110.

Preferably, the ramp portion 131 extending from the support base 121 of the slider body 110 is received in a recess defined in the bridge-shaped structure of the movable stop element 210 between the projections 218.

Preferably, the movable stop element 210 is housed in the cavity 150, except for the stop tooth 213 that is inserted in the through hole 132 and for the abutment tooth 215 that may be partially inserted into the cavity 129.

Preferably, the movable stop element 210 is made in a single piece.

In the preferred embodiment illustrated, the driving element 250 is conveniently substantially U-shaped and comprises two longitudinally extending arms 251 substantially parallel to each other and a joining section 252 extending between the parallel arms 251.

Preferably, the parallel portions are oriented in the longitudinal direction.

Preferably, the joining section 252 is oriented in a transverse direction.

In the preferred embodiment illustrated, the engagement portion 253 of the driving element 250 is arranged at said joining section 252 and is even more preferably formed by a central portion of the joining section 252.

Preferably, the driving element 250 is slidably mounted on the support base 121 and is movable in a longitudinal direction between an advanced position (illustrated in FIG. 12), corresponding to the operative position of the movable stop element 210 of the lock mechanism 200, and a retracted position (illustrated in FIG. 13), corresponding to the non-operative position of the movable stop element 210.

Preferably, the translation of the driving element 250 from the advanced position to the retracted position is directed in a longitudinal backward direction (i.e., in the direction from the first end 111 towards the second end 112 of the slider body 110 which corresponds to the opening direction of the zip fastener).

In the preferred embodiment illustrated, the ramp portion 131 extending from the support base 121 of the upper portion 140 of the slider body 110 is housed in a space 254 defined between the arms 251 of the driving element 250.

In the preferred embodiment illustrated, also the second end 212 of the movable stop element 210 is similarly housed in the space 254.

In this way, it is advantageously possible to achieve a correctly guided sliding movement of the driving element 250 in the longitudinal direction.

Preferably, the driving element 250 is housed in the cavity 150 of the protruding element 114 and the cavity 150 is configured to further guide the longitudinal sliding of the driving element 250 from the advanced position to the retracted position.

Preferably, the parallel sections 251 of the "U" shape are arranged so as to slide against respective longitudinal walls of the cavity 150 to guide this longitudinal sliding.

Preferably, the driving element 250 is configured to be moved:

i) by the release button 300 (from the advanced position to the retracted position) in contrast to the elastic force exerted by the elastic portion 214 of the movable stop element 210, and ii) by the elastic portion 214 of the movable stop element 210 (from the retracted position to the advanced position) when the pressure action exerted by the user on the release button 300 ceases.

In particular, the elastic force exerted by the elastic portion 214 of the movable stop element 210 is capable to displace the movable stop element 210 from its non-operative position towards its operative position thereby causing the displacement of the abutment portion 219 towards the ramp portion 131 and a simultaneous displacement of the engagement portion 253 which slides on the sliding surface 219*a* thereof from the retracted position towards the advanced position.

Preferably, the stop tooth 213 of the movable stop element 210 is housed in the space 254 defined between the parallel arms 251 of the driving element 250 so as not to hinder the translation of the driving element 250 between the advanced position and the retracted position.

Preferably, the driving element 250 further comprises at least one abutment end 255 configured to abut against the rear wall 152 of the protruding element 114 so as to create an end-stop of the driving element 250 in the retracted position.

More preferably, the driving element 250 comprises two abutment ends 255, each arranged at a longitudinal end of a respective parallel arm 251 of the "U" shape.

Preferably, the driving element 250 is made in a single piece.

As illustrated above, the release button 300 is movable between a non-operative position, corresponding to the operative position of the movable stop element 210 of the lock mechanism 200, and an operative or pressed position, corresponding to the non-operative position of the movable stop element 210.

Preferably, the release button 300 comprises a main body 305.

As illustrated above, the release button 300 has a pressure portion 310 facing the opposite direction with respect to the pressure portion 144 of the upper portion 140 of the slider body 110 and is movable from its non-operative position to its operative position by a pressure of a first finger on the pressure portion 310 and a simultaneous and opposite pressure of a second finger on the pressure portion 144.

Preferably, the pressure portion 310 is arranged on the main body 305 at a longitudinal end of the release button 300.

Preferably, the pressure portion 310 is perpendicular to the longitudinal direction.

The pressure portion 310 has a pressure surface onto which a user's fingertip can be placed to ergonomically press the release button 300.

Preferably, this pressure surface has an extension equal to at least 10% of a normal fingertip, still more preferably equal to at least 20%. Still more preferably at least 30%.

In this way, the pressure portion 310 allows the release button 300 to be ergonomically pressed.

Preferably, the pressures of the first finger and of the second finger are oriented longitudinally, i.e., along the X axis, and have directions opposite to each other.

Preferably, the cavity 150 formed in the protruding element 114 of the upper portion 140 of the slider body 110 is configured to guide a sliding of the release button 300 between its non-operative position and its operative or pressed position.

Preferably, such a sliding is longitudinal.

Preferably, the release button 300 is arranged in abutment relationship against the driving element 250 so as to move the latter from its advanced position to its retracted position (and consequently, to move the movable stop element 210 from its operative position to its non-operative or raised position in contrast to the elastic force exerted by the elastic portion 214) during the translation of the release button 300 from its non-operative position to its operative or pressed position.

Preferably, when the pressure portion 310 is not pressed, the release button 300 is moved from its operative position to the non-operative position by the force exerted by the elastic portion 214 of the movable stop element 210 which, as described above, causes the translation of the driving element 250 from the retracted position to the advanced position and a simultaneous rotation of the movable stop element 210.

It should be recalled that the driving element 250 is in abutment against the release button 300 so that it causes a corresponding translation of the release button 300 from its operative or pressed position to its non-operative position.

Preferably, the release button 300 comprises a substantially fork-shaped end portion 330 comprising two arms 320 extending longitudinally and substantially parallel to each other (see FIG. 11).

In this preferred embodiment, the arms 320 of the release button 300 are arranged in abutment against the driving element 250 at respective longitudinal ends.

Preferably, the parallel arms 320 of the release button 300 are oriented in the longitudinal direction.

Conveniently, the parallel arms 320 therefore transmit motion in the longitudinal direction from the release button 300 to the driving element 250 of the movable stop element 210.

In possible alternative embodiments, not illustrated, the parallel arms 320 may protrude from the driving element 250 to abut against the release button 300 (in which case the driving element 250 may have an "H" shape), or they may protrude both from the release button 300 towards the driving element 250 and from the driving element 250 towards the release button 300 so as to be arranged in mutual abutment.

Preferably, the second coupling portion 216 and the elastic portion 214 of the movable stop element 210 are arranged in a space 321 defined between the parallel arms 320 so as not to interfere with the translation of the release button 300 between the non-operative position and the operative or pressed position.

Preferably, the main body 305 of the release button 300 has a thickness measured in the vertical direction that is greater than that of the parallel arms 320, preferably at least the double or triple.

In this way, it is advantageously possible both to confer adequate strength characteristics to the release button 300 in its part subjected to the pressing action of the user, and to create an extension of the pressure portion 310 sufficient to guarantee its ergonomics.

Preferably, the cavity 150 of the protruding element 114 comprises, at the driving opening 151, an end portion having a dimension designed to house the main body 305.

Preferably, the release button 300 is made in a single piece.

From what has been illustrated above, the operation of the slider 1 in the opening and closing operations of the zip fastener is quite evident and will not be repeated for economy of exposition.

It goes without saying that a person skilled in the art may make numerous modifications and variations to the above-described slider in order to meet specific and contingent requirements, all of which are within the scope of protection of the present invention as defined by the following claims.

Thus, for example, in the slider 1 of the invention, a pull tab not configured to interact with the movable stop element 210 of the lock mechanism 200 may possibly be provided to meet particular application and/or aesthetic needs.

Such a possible pull tab could, for example, be associated with the upper portion 140 of the slider body 110 so as to facilitate, if desired, the displacement of the slider 1 in the zip closing direction, which displacement is not prevented as set forth further above by the lock mechanism 200.

The invention claimed is:

1. A slider for zip fasteners comprising:

a slider body comprising a first end at which two longitudinal sliding channels for teeth of a zip fastener open and a second end at which a single longitudinal sliding channel for the teeth of the zip fastener opens, the two channels joining in said single channel in said slider body;

a lock mechanism of the sliding of the slider positioned in the slider body and comprising a movable stop element of the sliding of the slider in a longitudinal direction and in an opening direction of the zip fastener;

a release button of the lock mechanism, slidably mounted in the slider body and manually operable to unlock the lock mechanism;

wherein the slider lacks any operating pull tab configured to interact with the lock mechanism; and wherein the release button is configured to cooperate with the movable stop element of the lock mechanism and move the movable stop element from an operative position, wherein the movable stop element engages one of said channels for locking a sliding of the slider along an opening direction of the zip fastener, to a non-operative position wherein the movable stop element does not engage any of said channels.

2. The slider according to claim 1, wherein the slider body comprises an upper portion provided with a side wall comprising a pressure portion and wherein the release button is mounted in the upper portion of the slider body at a longitudinally opposite part with respect to said pressure portion.

3. The slider according to claim 2, wherein the release button comprises a respective pressure portion and wherein the pressure portion of the side wall of the upper portion of the slider body and the pressure portion of the release button are aligned along a longitudinal sliding direction of the slider body.

4. The slider according to claim 2, wherein the upper portion of the slider body comprises a support base integrally formed with the slider body and a protruding element extending from the support base and wherein said protruding element is structurally independent from the support base and mechanically rigidly fixed, reversibly or irreversibly, to the support base.

5. The slider according to claim 4, wherein the protruding element of the upper portion of the slider body comprises a cavity formed above the support base and configured to at least partially house the lock mechanism of the sliding of the slider.

6. The slider according to claim 5, wherein the release button comprises a respective pressure portion and wherein the pressure portion of the side wall of the upper portion of the slider body and the pressure portion of the release button are aligned along a longitudinal sliding direction of the slider body and wherein the release button is partially housed in said cavity so that the respective pressure portion protrudes from a driving opening provided in the protruding element of the upper portion of the slider body.

7. The slider according to claim 6, wherein said release button protrudes from said driving opening for a length lower than 6 mm.

8. The slider according to claim 5, wherein said cavity is configured to guide a sliding of the release button in the protruding element of the upper portion of the slider body.

9. The slider according to claim 5, wherein said cavity comprises at least one lateral recess and said release button comprises at least one lateral protrusion housed in said at least one lateral recess to define an end-stop of the release button.

10. The slider according to claim 1, wherein said lock mechanism comprises a driving element that is longitudinally interposed between the release button and the movable stop element.

11. The slider according to claim 10, wherein the movable stop element of the sliding of the slider is substantially bridge-shaped and comprises:

i) a recess wherein an engagement portion of the driving element is housed; and ii) an abutment portion engageable by the engagement portion;

wherein said engagement portion is configured to cooperate with said abutment portion to move the movable stop element from its operative position to its non-operative position.

12. The slider according to claim 11, wherein said abutment portion has a sliding surface facing the longitudinal sliding channels of the teeth of the zip fastener and inclined with respect to the longitudinal direction, the engagement portion of the driving element being configured to slide against the sliding surface during a longitudinal translation of the engagement portion towards the second end of the slider body to move the movable stop element from its operative position to its non-operative position.

13. The slider according to claim 11, wherein the upper portion of the slider body comprises a support base integrally formed with the slider body and a protruding element extending from the support base, wherein the slider body comprises a ramp portion extending from the support base of the upper portion of the slider body and wherein the engagement portion of the driving element is configured to slide against the ramp portion so as to move away from said support base during a longitudinal translation of the driving element towards the second end of the slider body.

14. The slider according to claim 11, wherein the upper portion of the slider body comprises a support base integrally formed with the slider body and a protruding element extending from the support base, wherein said recess of the movable stop element defines a through opening between the movable stop element and the support base of the upper portion of the slider body and wherein said engagement portion of the driving element is housed in said through opening.

15. The slider according to claim 11, wherein the movable stop element extends from a first end to a second end opposite to the first end and further comprises:

iii) a stop tooth formed at the second end and configured to engage one of said longitudinal sliding channels of the teeth of the zip fastener when the movable stop element is in its operative position, iv) an elastic portion formed at the first end and configured to push the movable stop element towards its operative position.

16. The slider according to claim 11, wherein said driving element is substantially U-shaped and comprises two longitudinally extending arms, substantially parallel to each other, and a joining section extending between said parallel arms and wherein the engagement portion of the driving element is arranged at said joining section.

17. The slider according to claim 13, wherein said driving element is substantially U-shaped and comprises two longitudinally extending arms, substantially parallel to each other, and a joining section extending between said parallel arms and wherein the engagement portion of the driving element is arranged at said joining section and wherein the ramp portion extending from the support base of the upper portion of the slider body is housed in a space defined between the arms of the driving element.

18. The slider according to claim 1, wherein said release button comprises a substantially fork-shaped end portion comprising two arms extending longitudinally and substantially parallel to each other.

19. The slider according to claim 10, wherein the arms of the release button are arranged in abutment against the driving element at respective longitudinal ends.

20. The slider according to claim 18, wherein the upper portion of the slider body comprises a support base integrally formed with the slider body and a protruding element extending from the support base, wherein the slider body comprises a first coupling portion of the movable stop element to the slider body protruding from the support base of the upper portion of the slider body next to said first end of the slider body and wherein said first coupling portion is received in a space defined between the arms of the release button.

21. The slider according to claim 4, wherein the slider body comprises a first coupling portion of the movable stop element to the slider body protruding from the support base of the upper portion of the slider body next to said first end of the slider body and wherein said movable stop element comprises a second coupling portion which cooperates with the first coupling portion to define a rotation hinge between the movable stop element and the slider body.

22. The slider according to claim 21, wherein the protruding element of the upper portion of the slider body comprises a cavity formed above the support base and configured to at least partially house the lock mechanism of the sliding of the slider and wherein the first coupling portion of the movable stop element to the slider body and the second coupling portion of the movable stop element are housed in said cavity.

23. The slider according to claim 4, wherein the protruding element of the upper portion of the slider body comprises a decorative element or is configured as a three-dimensional decorative element.

* * * * *